United States Patent [19]

Bert et al.

[11] 4,375,713

[45] Mar. 8, 1983

[54] CLASP FOR ADJUSTING BRACELET LENGTH

[75] Inventors: Stephen F. Bert, Warwick, R.I.; Richard E. Ripley, Attleboro, Mass.; Kurt A. Rieth, Warwick, R.I.

[73] Assignee: Textron, Inc., Providence, R.I.

[21] Appl. No.: 218,345

[22] Filed: Dec. 22, 1980

[51] Int. Cl.[3] ..... A44B 11/00; A44C 5/18

[52] U.S. Cl. ..... 24/206 R; 24/265 WS; 224/164

[58] Field of Search ..... 24/71 J, 70 J, 265 WS, 24/265 BC, 265 R, 206 R, 265 B, 191; 224/175, 164

[56] References Cited

U.S. PATENT DOCUMENTS

| | | | |
|---|---|---|---|
| 1,591,295 | 7/1926 | Donaldson | 24/265 WS |
| 1,648,015 | 11/1927 | Freysinger | 24/191 |
| 1,760,913 | 6/1930 | Otten | 24/265 WS |
| 1,820,393 | 8/1931 | Kestenman | 24/191 |
| 1,945,266 | 1/1934 | Einsele | 24/206 R |
| 2,215,527 | 9/1940 | Kestenman | 24/71 J |
| 3,665,564 | 5/1972 | Oka | 24/265 |
| 4,000,542 | 1/1977 | Omichi | 24/265 WS |
| 4,096,688 | 6/1978 | Rieth | 224/175 |
| 4,280,257 | 7/1981 | Kostanecki | 24/206 R |
| 4,296,532 | 10/1981 | Ho | 24/206 R |

FOREIGN PATENT DOCUMENTS

| | | | |
|---|---|---|---|
| 1287476 | 2/1962 | France | 24/265 WS |

*Primary Examiner*—Paul J. Hirsch

*Attorney, Agent, or Firm*—Thompson, Birch, Gauthier & Samuels

[57] ABSTRACT

For use in combination with an expansible linkage bracelet of the type having rows of overlapping resiliently interconnected upper and lower links, a clasp adapted for adjustable and detachable connection to an end portion of the bracelet. The clasp has a casing with a base wall and upturned side walls defining a channel for receiving the bracelet end portion. A lid having a top wall with downturned side walls is mounted for pivotal movement relative to the casing between open and closed positions respectively exposing and enclosing the receiving channel. Engagement members at one end of the clasp are arranged to protrude between selected laterally adjacent pairs of upper and lower bracelet links, thereby retaining the bracelet end portion within the receiving channel when the lid is in the closed position.

13 Claims, 18 Drawing Figures

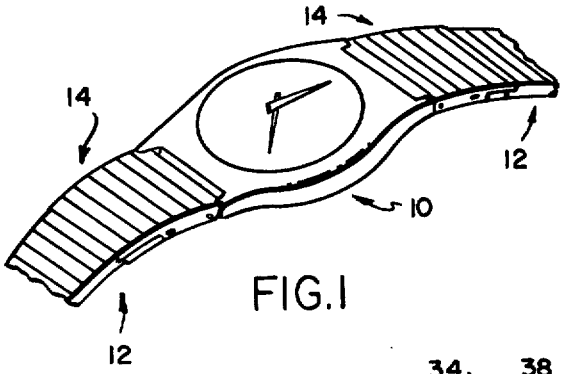
FIG.1
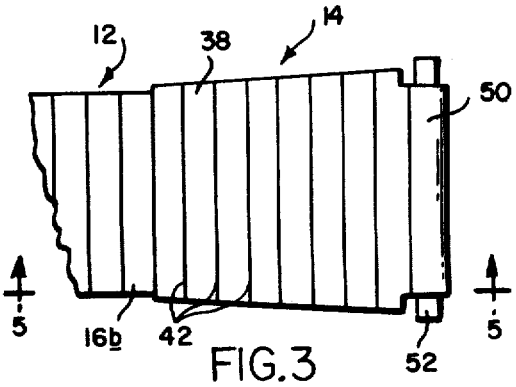
FIG.3
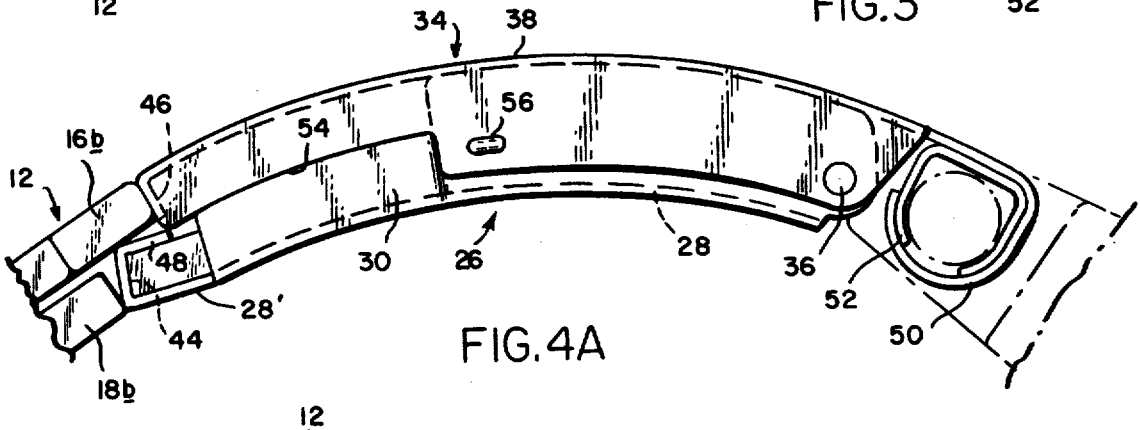
FIG.4A
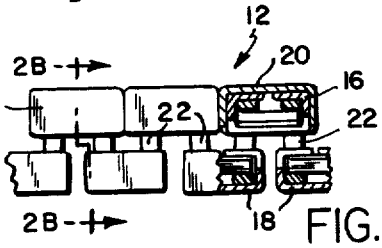
FIG.2A
FIG.2B
FIG.2C
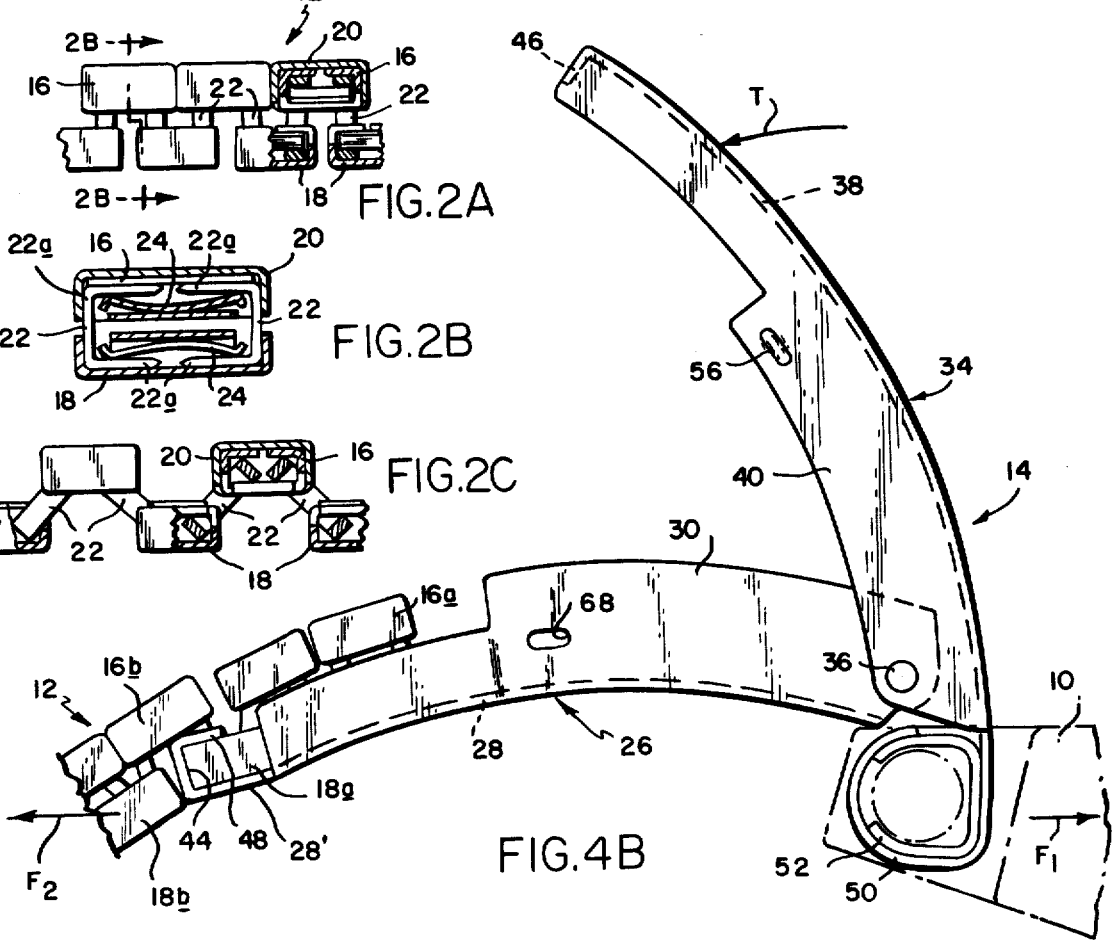
FIG.4B

CLASP FOR ADJUSTING BRACELET LENGTH

BACKGROUND OF THE INVENTION

1. Field of the Invention

This invention relates generally to expansible linkage bracelets of the type having rows of overlapping resiliently interconnected upper and lower links and is concerned in particular with an improved clasp adapted for adjustable and detachable connection to end portions of such bracelets.

2. Description of the Prior Art

A number of adjustable clasps have been developed in the past for use with various jewelry items, including bracelets, necklaces, etc. Examples of such prior art bracelets are shown in U.S. Pat. No. 4,000,542 (Omichi); U.S. Pat. No. 3,685,106 (Gandelman); U.S. Pat. No. 3,557,412 (Hauser); U.S. Pat. No. 2,586,758 (Zerr); U.S. Pat. No. 2,457,200 (Bikoff); U.S. Pat. No. 1,760,913 (Otten); U.S. Pat. No. 1,641,372 (Chilson); U.S. Pat. No. 1,591, 295 (Donaldson); U.S. Pat. No. 283,333 (Etzensperger) and French Pat. No. 38,427 (published in 1931).

A principal object of the present invention is to provide an improved bracelet clasp which is simple and economical in design, attractive in appearance, and which can be employed to adjust the overall length of the bracelet in a quick and relatively simple manner without requiring tools or special skills.

The clasp according to the present invention has base and lid components designed to coact in an adjustable detachable manner with a bracelet of the type having rows of overlapping resiliently interconnected upper and lower links. The casing has a base wall and upturned sides defining a channel for receiving an end portion of the bracelet. The lid has a top wall and downturned sides. The lid is mounted for pivotal movement relative to the casing between open and closed positions respectively exposing and enclosing the channel. One end of the clasp has engagement members which protrude between selected pairs of the upper and lower bracelet links when the lid is closed. The opposite end of the clasp is adapted for connection to another component, for example a watch casing or another bracelet section. The length of the bracelet is adjusted by opening the lid, inserting an appropriate length of a bracelet end portion into the aforesaid channel, and then reclosing the lid.

BRIEF DESCRIPTION OF THE DRAWINGS

Other objects and advantages of the invention will appear from the following description of several preferred embodiments, and the novel features thereof will be particularly pointed out in the appended claims and attached drawings in which:

FIG. 1 is a perspective view of a wristwatch/bracelet combination employing two clasps in accordance with one embodiment of the present invention;

FIG. 2A is a side elevational view with portions broken away showing the bracelet in its contracted condition;

FIG. 2B is a sectional view taken along lines 2B—2B of FIG. 2A;

FIG. 2C is a view similar to FIG. 2A showing the bracelet in its expanded condition;

FIG. 3 is an enlarged plan view of one of the clasps shown in FIG. 1;

FIG. 4A is a still further enlarged side elevational view of the clasp shown in FIG. 2;

FIG. 4B is a view similar to FIG. 4A showing the clasp in the open condition;

DESCRIPTION OF THE PREFERRED EMBODIMENTS

Figure 5:
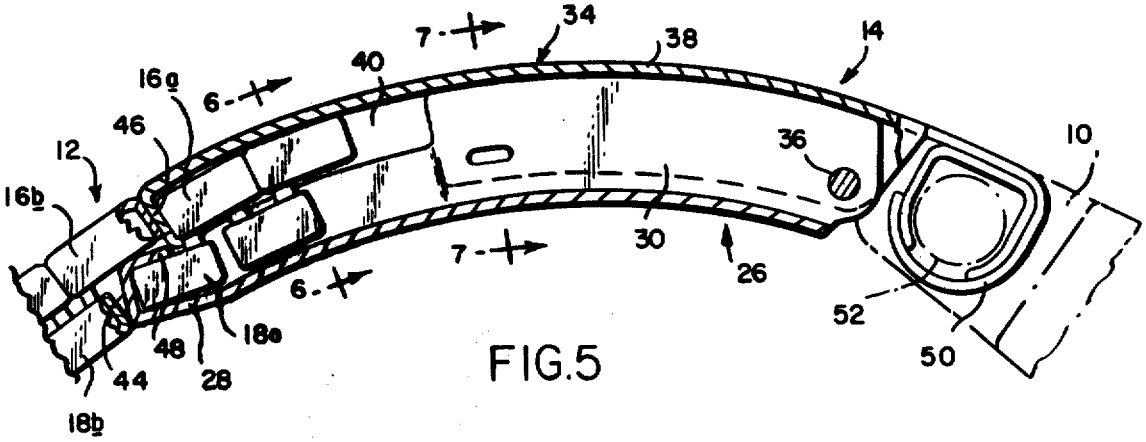
FIG. 5 is a sectional view, again on an enlarged scale, taken along lines 5—5 of FIG. 2.
Figure 6:
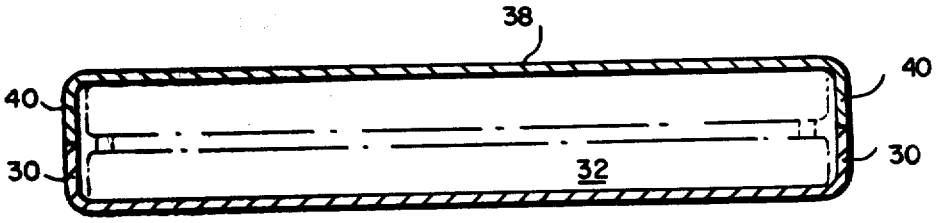
FIGS. 6 and 7 are sectional views taken respectively along lines 6—6 and 7—7 of FIG. 5.
Figure 7:
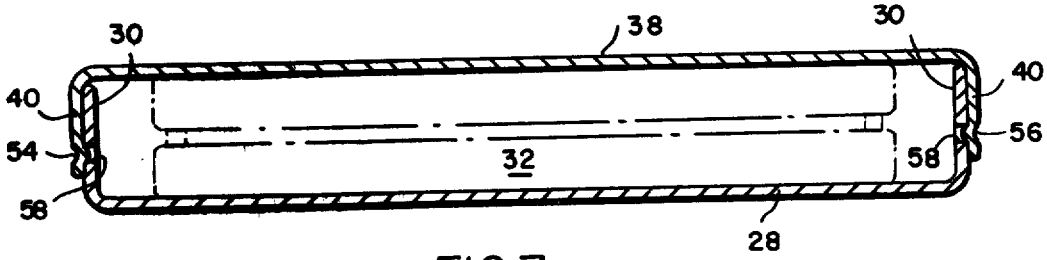

Referring initially to FIG. 1, a conventional wristwatch 10 is shown connected to opposite ends of an expansible linkage bracelet 12 by means of a pair of clasps 14 in accordance with one embodiment of the invention. As can be best seen in FIGS. 2A—2C, the bracelet 12 is of conventional design, having rows of upper and lower box-shaped overlapping links 16, 18, with the upper links being covered by decorative shells 20. The links are resiliently interconnected by staples 22 having legs **22*a* which protrude into the ends of the links. The legs 22*a* are acted upon by springs 24. This construction allows the bracelet to be resiliently adjusted between a fully contracted state as shown in FIG. 2A and an expanded state as shown in FIG. 2C**.

Figure 8:
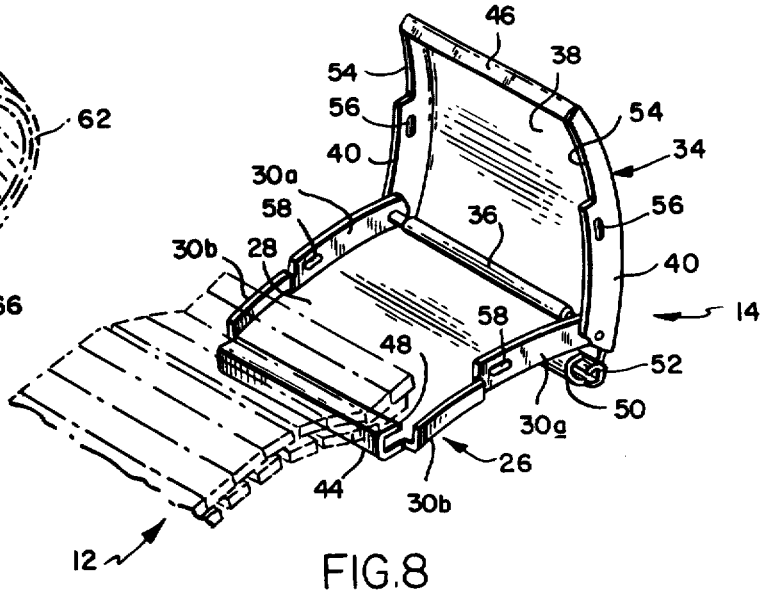
FIG. 8 is a perspective view of the open clasp.

Referring additionally to FIGS. 3–8, it will be seen that the clasp 14 includes a lower casing 26 having a base wall 28 and upturned sides 30 defining a channel 32 appropriately dimensioned to receive an end portion of the bracelet 12. A lid 34 is connected to the casing 26 by means of a conventional spring bar 36. The lid has a top wall 38 with downturned sides 40. The exterior surface of the top wall 38 is provided with an appropriate decorative design, for example grooves 42 matching the design of bracelet 12. The lid is pivotally adjustable about the axis of spring bar 36 between an open position as shown in FIG. 4B and FIG. 8 at which the channel 32 is exposed, and a closed position as shown for example in FIGS. 3, 4A and 5 at which the channel is enclosed.

The clasp 14 has a first engagement means at one end thereof which includes an upwardly protruding end flange 44 on the base wall 28, and a downwardly protruding end flange 46 on the top wall 38. As is best shown in FIG. 5, when an end portion of the bracelet 12 is received in the channel 32, the upwardly protruding flange 44 is located between a pair **18*a*, 18*b* of the lower links, and the downwardly protruding flange 46 likewise is located between a pair 16*a*, 16*b* of the upper links. The flanges 44, 46 are offset laterally one from the other by approximately one-half the width of a bracelet link in order to accommodate the overlapping offset relationship of the upper and lower bracelet links. Preferably, the upwardly protruding end flange 44 has inturned lip 48 which cooperates with the base wall 28 to removably confine the lower link 18***a* therebetween.

The clasp has second engagement means at its opposite end consisting of another inturned lip 50 on the top wall 38 enclosing a second larger diameter spring bar 52. The spring bar 52 serves as the means of attaching the clasp to the wristwatch 10. The axis of spring bar 36 is parallel to and spaced inwardly from the axis of spring bar 52. With this arrangement, as shown in FIG. 4B, if opposing forces $F_1$, $F_2$ are exerted respectively on the watch 10 and bracelet 12, a resultant torque T will urge the lid 34 into its closed position.

As is best shown in FIG. 3, when viewed in plan, the casing and lid sections of the clasp 14 are tapered in width to provide an aesthetically pleasing transition between the bracelet 12 and the wristwatch 10. The downturned sides 40 of the lid are generally flat, with notches 54 in their bottom edges extending inwardly from the end flange 46, and with inwardly protruding bosses 56 located inwardly of the notches 54. As is best shown in FIG. 8, the upturned sides of the casing 26 have first indented portions 30*a* overlapped by the downturned sides of lid 34, 40, and second portions 30*b* arranged in coplanar relationship with the downturned sides 40 at the narrower end of the clasp. The indented portions 30*a* have apertures 58 arranged to receive the bosses 56 on the downturned sides 40 to provide a detent-type latch means for retaining the lid 34 in its closed position.

The clasp 14 will normally be attached to the wristwatch by a jeweler who has the skill and tools required to resiliently manipulate the ends of the spring bar 52. Thereafter, the bracelet 12 can be adjustably and detachably connected to the clasp without any requirement for special skills or separate tools, simply by: (a) opening the lid 34 to the position shown in FIGS. 4B and 8 to expose the channel 32; (b) inserting a bracelet end portion of appropriate length into the channel, with the upwardly protruding end flange 44 being received between a selected pair 18*a*, 18*b* of lower links, and with link 18*a* being overlapped by the inturned lip 48; and (c) reclosing the lid to locate the downturned end flange 46 between a selected pair 16*a*, 16*b* of upper links, with the bosses 56 being engaged in their respective apertures 58. This procedure can be repeated as many times as is necessary to properly adjust the overall length of the bracelet portion outside of the clasp 14.

Preferably, as is best shown in FIGS. 4A and 5, the base and top walls 28, 38 and their respective upturned and downturned sides 30, 40 are curved about a common axis extending in a direction transverse to the length of channel 32. Advantageously, the bottom wall 28 has a portion 28' adjacent to the upturned end flange 44 which is inclined upwardly at an angle, thereby causing the bottom link 18*a* to be correspondingly inclined upwardly. This in turn elevates the top link 16*b* slightly to provide a smooth transition between the clasp and bracelet.

Figure 9:
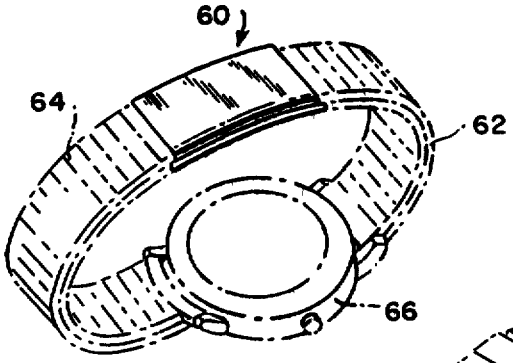
FIG. 9 is a perspective view of a wristwatch/bracelet combination including an alternate embodiment of a clasp in accordance with the present invention.

Referring now to FIG. 9, a clasp in accordance with an alternate embodiment of the invention is shown at 60 connecting adjacent end portions of two expansible linkage bracelet sections 62, 64 of the same type as described previously. In this arrangement, the other ends of the bracelet sections are connected to a wristwatch 66 by conventional spring bars (not shown).

With reference additionally to FIGS. 10–15, it will be seen that the clasp 60 has a bottom casing 68 and an upper lid 70. The casing 68 has a base wall 72 and upturned sides 74 defining a channel 76. The lid 70 is pivotally associated with the casing 68 for movement between closed and open positions shown respectively in FIGS. 10 and 11. The lid has a top wall 78 and downturned sides 80. The clasp 60 has a first engagement means at one end thereof which includes an upwardly protruding end flange 82 on the base wall 72, and a downwardly protruding end flange 84 on the top wall 78. Flange 82 is preferably additionally provided with an inturned lip 86.

Figure 10:
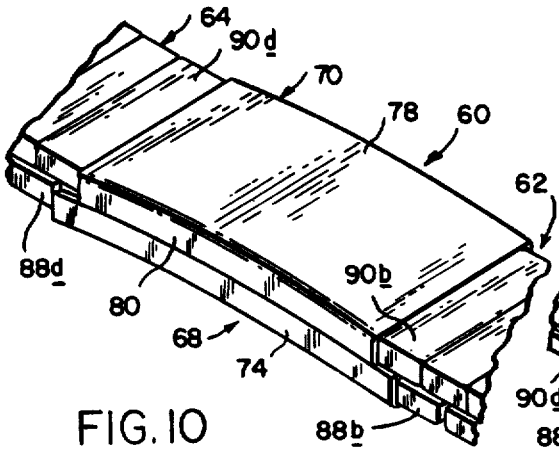
FIG. 10 is a perspective view on an enlarged scale of the clasp shown in FIG. 9.
Figure 11:
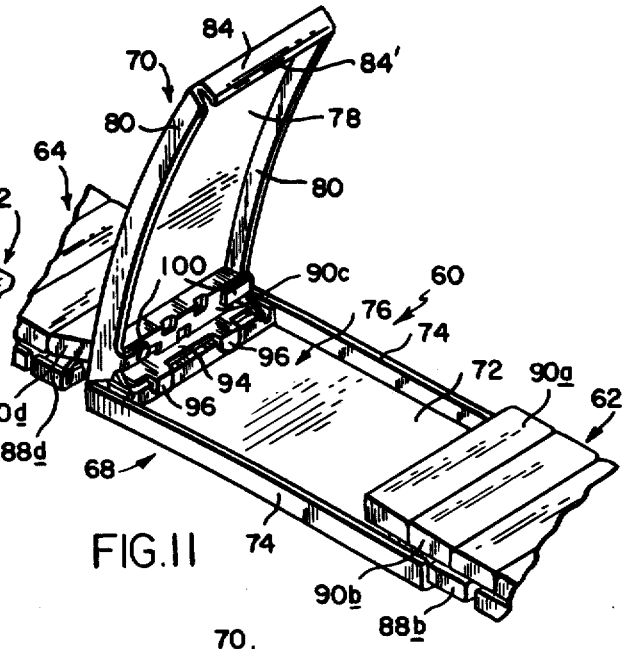
FIG. 11 is a view similar to FIG. 10 showing the clasp in the open condition.
Figure 12:
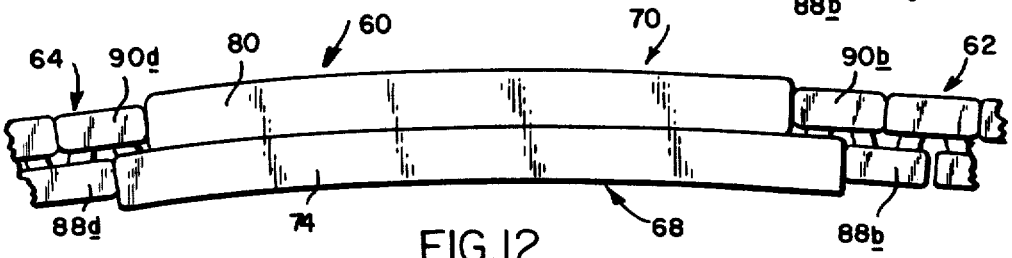
FIG. 12 is a side elevational view of the clasp shown in FIGS. 9, 10 and 11, with the lid in the closed position.
Figure 13:
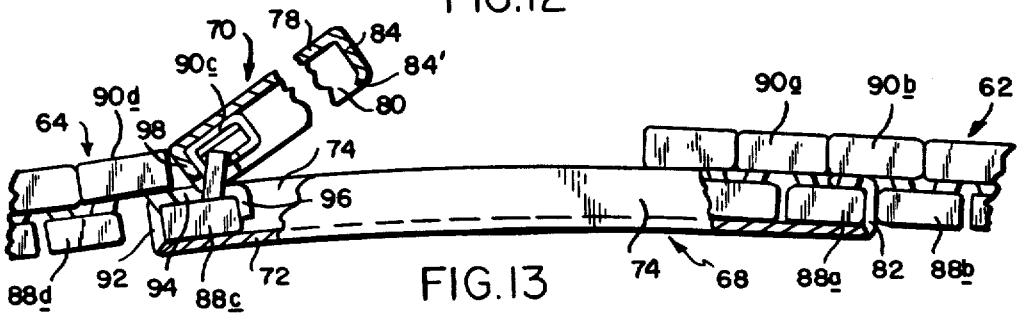
FIG. 13 is a view similar to FIG. 12, with the lid in the open position and with portions of the lid and casing broken away.
Figure 14:
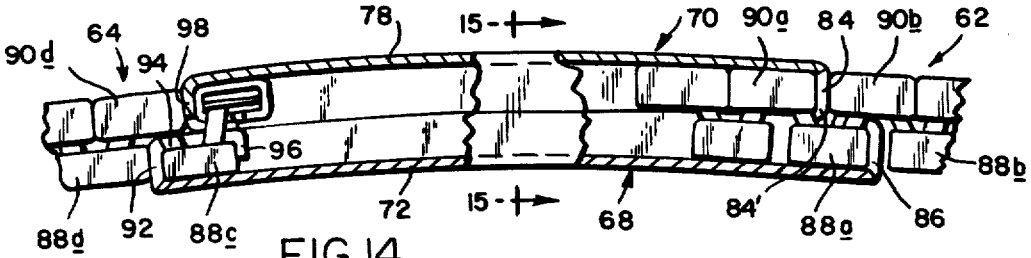
FIG. 14 is a view similar to FIG. 13 with the lid in the closed position.

When the lid 70 is opened as shown in FIG. 11, an appropriate length of one bracelet end portion can be inserted in the channel 76. The upwardly protruding end flange 82 will be received between a selected pair of the lower links 88*a*, 88*b*, with the lip 86 cooperating with the base wall 72 to removably retain link 88*a* therebetween. When the lid 70 is closed as shown in FIGS. 10, 12 and 14, the channel 76 and the bracelet end portion located therein are enclosed, and the downwardly protruding end flange 84 is received between a selected pair of upper links 90*a*, 90*b*. Advantageously, the end flange 84 may be provided with a slight inwardly extending lip 84' which will cooperate with the bracelet link 90*a* in providing a modified snap closure.

Figure 15:
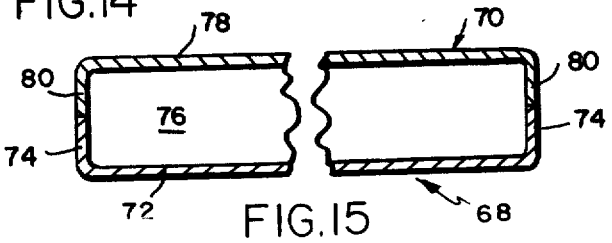
FIG. 15 is a sectional view taken along lines 15—15 of FIG. 14.

The opposite end of the clasp 60 has a second engagement means which serves both to connect the clasp to the other bracelet section 64 and to pivotally join the lid 70 to the casing 68. The second engagement means includes an upwardly protruding end flange 92 which is parallel to flange 82 and which protrudes upwardly between lower links 88*c*, 88*d*. Flange 92 has an inwardly extending lip 94 with tabs 96 bent around lower link 88*c* to fix it relative to the casing 68 at one end of the channel 76. The second engagement means also includes a downwardly protruding flange 98 on top wall 78 which is received between upper links 90*c*, 90*d* (link 90*c* being shown without a top decorative shell), and end tabs 100 on the sides 80 which are bent inwardly around top link 90*c* to fix it relative to the lid 70. With this arrangement, the resilient interconnection between upper link 90*c* and lower link 88*c* (identical to that depicted in FIGS. 2A–2C) establishes a pivotal connection between the casing 68 and lid 70 (compare FIGS. 13 and 14). As is best shown in FIG. 15, in this embodiment the upwardly protruding sides 74 are arranged in coplanar relationship with the downwardly protruding sides 80.

The clasp 60 may be operated in basically the same way as clasp 14 to provide a means of adjusting the overall length of the bracelet section.

We claim:

1. For use in combination with an expansible linkage bracelet of the type having upper and lower links which are resiliently interconnected and offset in the direction of the bracelet length, a clasp adapted for adjustable and detachable connection to an end portion of the bracelet, comprising:

a casing having a base wall and upturned side walls defining a channel for receiving the bracelet end portion;

a lid having a top wall with downturned side walls, said lid being mounted for pivotal movement relative to said casing between open and closed positions respectively exposing and enclosing said channel; and engagement means at one end of said clasp, said engagement means including a first end flange on said base wall arranged to protrude upwardly between a selected adjacent pair of the lower links of said bracelet and a second end flange on said top wall arranged to protrude downwardly between a selected adjacent pair of the upper links of said bracelet, said first and second end flanges being offset one from the other to accommodate the offset relationship of said upper and lower links when said lid is in the closed position.

2. The clasp of claim 1 wherein said upwardly protruding end flange has an inturned lip cooperating with said base wall to confine a lower link therebetween.

3. The clasp of claim 1 further comprising second engagement means at the opposite end of said clasp for connecting said clasp to a component associated with said bracelet.

4. The clasp of claim 3 wherein said second engagement means consists of a spring bar enclosed by an inturned lip on said top wall.

5. The clasp of claim 4 wherein said lid is connected to said casing for pivotal movement about an axis parallel to and spaced inwardly from said spring bar.

6. The clasp of claim 3 wherein said bracelet end portion is on a first bracelet section, said component consists of a second expansible bracelet linkage section also having rows of overlapping resiliently interconnected upper and lower links, and wherein said second engagement means comprises an end portion of said base wall bent around and fixed relative to an endmost lower link of said second linkage section, and an end portion of said lid bent around and fixed relative to an endmost top link of said second linkage section.

7. The clasp of claim 1 further comprising latch means for releasably locking said lid in said closed position.

8. The clasp of claim 7 wherein said upturned side walls have first indented portions overlapped by said downturned side walls and second portions arranged in coplanar relationship with said downturned side walls.

9. The clasp of claim 8 wherein said casing and lid are tapered in widths as viewed in plan, and wherein the coplanar portions of said upturned and downturned side walls are at the narrower end of said clasp.

10. The clasp of claim 9 wherein said latch means comprises detents consisting of cooperating bosses and apertures on the overlapping portions of said side walls.

11. The clasp of claim 1 wherein said base wall and said top wall and the upturned and downturned sides respectively associated therewith are curved about a common axis extending in a direction transverse to the length of said channel.

12. For use in combination with an expansible linkage bracelet of the type having upper and lower links which are resiliently connected and offset in the direction of the bracelet length, a clasp adapted for adjustable connection to an end portion of the bracelet, comprising:

a casing having a base wall and upturned side walls defining a channel for receiving the bracelet end portion with lower engagement means at one end of said casing protruding upwardly from said base wall between a selected pair of the lower bracelet links; and a lid having a top wall with downturned side walls and an upper engagement means, said lid being mounted for pivotal movement relative to said casing between an open position exposing said channel to accommodate insertion therein of the bracelet end portion, and a closed position concealing said channel and the bracelet end portion inserted therein with said upper engagement means protruding between a selected pair of the upper bracelet links, said upper and lower engagement means being offset one from the other to accommodate the offset relationship of said upper and lower links.

13. For use in combination with an expansible linkage bracelet of the type having a row of upper links overlying a row of lower links, said upper links being offset in the direction of the bracelet length relative to said lower links, and said upper and lower links being interconnected in a manner permitting the bracelet length to be resiliently expanded by increasing the offset between said upper and lower links, a clasp for connecting said bracelet to another component, said clasp comprising:

a clasp body defining a link retaining enclosure;

first means at one end of said body for connecting said clasp to the said another component; and second means at the opposite end of said body for connecting said clasp to said bracelet, said second means having a lower engagement member adapted to be positioned between a selected pair of said lower links, and an upper engagement member adapted to be positioned between a selected pair of said upper links, said upper and lower engagement members being offset one from the other to accommodate the offset relationship of said upper and lower links.

* * * * *